US012225998B2

(12) United States Patent
Hwang

(10) Patent No.: US 12,225,998 B2
(45) Date of Patent: Feb. 18, 2025

(54) CONTAINER FOR MIXING DIFFERENT TYPES OF COSMETIC CONTENTS

(71) Applicant: F.S.KOREA INDUSTRIES INC., Seoul (KR)

(72) Inventor: Jae Kwang Hwang, Seoul (KR)

(73) Assignee: F.S.KOREA INDUSTRIES INC., Seoul (KR)

( * ) Notice: Subject to any disclaimer, the term of this patent is extended or adjusted under 35 U.S.C. 154(b) by 394 days.

(21) Appl. No.: 17/787,272

(22) PCT Filed: Dec. 19, 2019

(86) PCT No.: PCT/KR2019/018130
§ 371 (c)(1),
(2) Date: Jun. 17, 2022

(87) PCT Pub. No.: WO2021/125396
PCT Pub. Date: Jun. 24, 2021

(65) Prior Publication Data

US 2023/0020394 A1 Jan. 19, 2023

(51) Int. Cl.
*A45D 40/24* (2006.01)
*A45D 34/00* (2006.01)
(Continued)

(52) U.S. Cl.
CPC ..... *A45D 40/24* (2013.01); *A45D 34/00* (2013.01); *A45D 40/26* (2013.01); *B65D 81/3211* (2013.01); *A45D 2034/002* (2013.01)

(58) Field of Classification Search
CPC ..... A45D 40/24; A45D 34/00; A45D 40/00; A45D 2034/002; A45D 40/26; B65D 81/3211
(Continued)

(56) References Cited

U.S. PATENT DOCUMENTS 4,105,142 A * 8/1978 Morris, Jr. ..... G01F 19/00 141/319
4,757,916 A * 7/1988 Goncalves ..... B65D 81/3211 222/153.07
(Continued)

FOREIGN PATENT DOCUMENTS

KR 10-1817163 B1 1/2018
KR 10-1985002 B1 6/2019
WO WO-2016099130 A1 * 6/2016 ..... A45D 34/00

*Primary Examiner* — Rafael A Ortiz
(74) *Attorney, Agent, or Firm* — Lucem, PC; Heedong Chae

(57) ABSTRACT

A mixing container for different kinds of makeup is disclosed. The mixing container includes: a first container configured to store a first kind of makeup; a second container detachably coupled to the first container and configured to store a second kind of makeup; and a mixing unit coupled to the second container to be movable up and down and configured to discharge the second kind of makeup to the first container such that the first kind of makeup and the second kind of makeup are mixed, in which the first container and the second container are independently separated, and when the first container and the second container are coupled and then the mixing unit is pressed, the mixing unit bores a portion of the second container and the second kind of makeup stored in the second container enters the first container.

4 Claims, 7 Drawing Sheets

(51) Int. Cl.
*A45D 40/26* (2006.01)
*B65D 81/32* (2006.01)

(58) Field of Classification Search
USPC ..... 206/385, 229, 568, 223, 581, 219; 220/80
See application file for complete search history.

(56) References Cited

U.S. PATENT DOCUMENTS

| | | | | |
|---|---|---|---|---|
| 5,692,644 | A * | 12/1997 | Gueret | B05B 11/0083 222/129 |
| 7,562,771 | B2 * | 7/2009 | Fontana | B65D 51/285 206/568 |
| 2007/0215496 | A1 * | 9/2007 | Scarborough | B65D 51/221 206/219 |
| 2008/0245683 | A1 * | 10/2008 | McKenna | B65D 51/2835 222/129 |
| 2013/0228482 | A1 * | 9/2013 | Son | B65D 81/3266 206/219 |
| 2018/0079584 | A1 * | 3/2018 | Jung | B65D 81/32 |

* cited by examiner

CONTAINER FOR MIXING DIFFERENT TYPES OF COSMETIC CONTENTS

BACKGROUND OF THE INVENTION

Field of the Invention

The present disclosure relates to a cosmetic container and, more particularly, a mixing container for different kinds of makeup, the cosmetic container making it possible to mix and use different kinds of makeup that are separately stored.

Description of the Related Art

In general, cosmetic containers on the market are filled with one kind of makeup for use.

As described above, since one cosmetic container is filled with one kind of makeup for use, people who put on a plurality of kinds of makeup have to separately purchase containers filled with makeup. Accordingly, not only purchasing costs increase, but they have to carry several containers filled with several kinds of makeup, respectively, so it is inconvenient.

Further, makeup manufactures have to manufacture separate containers, fill the containers with makeup, and then sell cosmetic products, so the manufacturing cost of cosmetic products containing makeup increases.

Further, when two kinds of makeup with different ingredients are mixed in advance, there are problems such as a change in quality or remarkable deterioration of function due to chemical reactions in the mixed state.

In order to solve these problems, combination containers for different kinds of makeup that separately stores two kinds of makeup in one container and enables the two kinds of makeup to be mixed and used when they are operated by a user have been disclosed.

According to the combination containers for different kinds of makeup of the related art, two different kinds of makeup are stored in one body, but the containers storing the makeup, respectively, are provided initially in an integrated state, whereby it is difficult to replace the makeup with other kinds of makeup and there are a small number of choices, so improvement measures against these problems are required.

The above description is the background for helping understand the present disclosure and does not means the related art well known in the art.

SUMMARY OF THE INVENTION

Therefore, an objective of the present disclosure is to provide a mixing container for different kinds of makeup, the cosmetic container being able to mix different kinds of makeup, making it possible to easily replace the makeup with other kinds of makeup, and being able to providing more choices by having independent cosmetic containers storing different kinds of makeup, respectively.

According to an aspect of the present disclosure, there may be provided a mixing container for different kinds of makeup, the mixing container including: a first container configured to store a first kind of makeup; a second container detachably coupled to the first container and configured to store a second kind of makeup; and a mixing unit coupled to the second container to be movable up and down and configured to discharge the second kind of makeup to the first container such that the first kind of makeup and the second kind of makeup are mixed, in which the first container and the second container are independently separated, and when the first container and the second container are coupled and then the mixing unit is pressed, the mixing unit bores a portion of the second container and the second kind of makeup stored in the second container enters the first container, so the first kind of makeup and the second kind of makeup are mixed with each other.

The first container may include: a first container body configured to store the first kind of makeup; a discharger disposed under the first container body and configured to discharge the first kind of makeup stored in the first container body out of the first container body; and a first container cap detachably coupled to an upper portion of the first container body, and the second container may be detachably coupled to a region of the first container body from which the first container cap has been separated.

The second container may include: a second container body configured to store the second kind of makeup; a second container storage body coupled inside the second container body and configured to store the second kind of makeup; and a second container separation cap detachably coupled to the second container body to surround the second container storage body.

The second container separation cap and the first container cap of the first container may be separated to couple the second container to the first container, and an outer wall of the second container body may be thread-fastened to the region of the first container body from which the first container cap has been separated.

The mixing unit may include: a mixing body coupled to an inner wall of the second container storage body to be movable up and down; a boring blade disposed at the mixing body and configured to bore a boring portion formed in the second container storage body; and a mixing head formed to be exposed to the outside of the second container body and configured to be pressed by a user.

The first container and the second container are independently separated, and when the mixing unit is pressed after the first container and the second container are coupled, the second kind of makeup stored in the second container enters the first container, so the first kind of makeup the second kind of makeup are mixed with each other. Accordingly, it possible to easily replace the makeup with other kinds of makeup and provide more choices of makeup.

BRIEF DESCRIPTION OF THE DRAWINGS

The above and other objectives, features and other advantages of the present invention will be more clearly understood from the following detailed description when taken in conjunction with the accompanying drawings, in which.

DETAILED DESCRIPTION OF THE INVENTION

Figure 1:
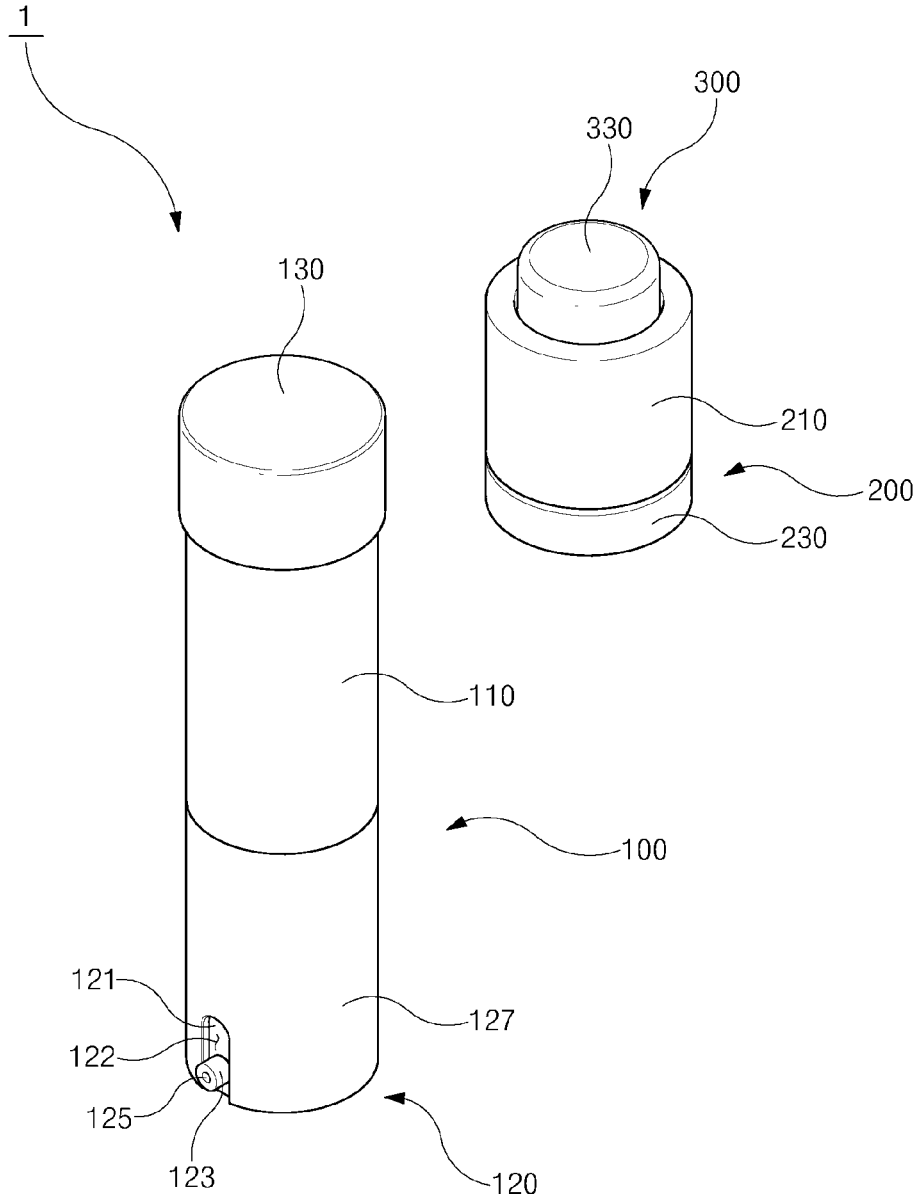
FIG. 1 is a view schematically showing a mixing container for different kinds of makeup according to an embodiment of the present disclosure.
Figure 2:
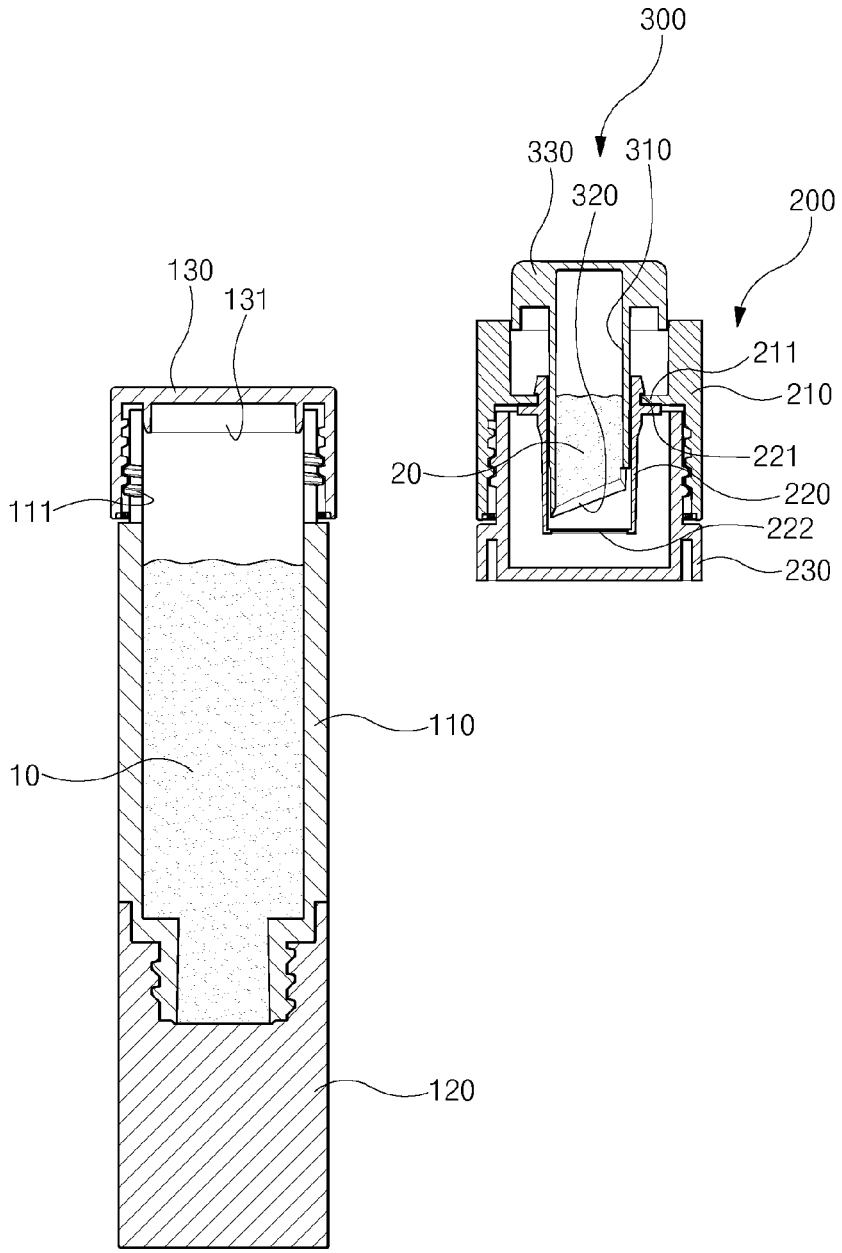
FIG. 2 is a front view of FIG. 1.
Figure 3:
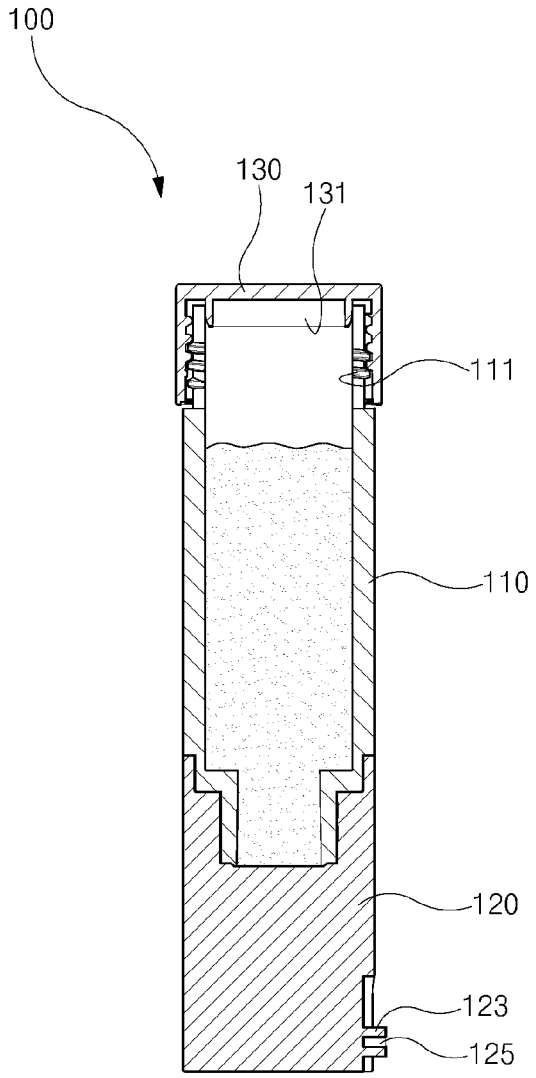
FIG. 3 is a cross-sectional view of a first container shown in FIG. 1.

FIG. 1 is a view schematically showing a mixing container for different kinds of makeup according to an embodiment of the present disclosure, FIG. 2 is a front view of FIG. 1, and FIG. 3 is a cross-sectional view of a first container shown in FIG. 1.

As shown in the figures, a mixing container 1 for different kinds of makeup according to the embodiment includes a first container 100 storing a first kind of makeup 10, a second container 200 storing a second kind of makeup 20 and configured to detachably coupled to the first container 100, and a mixing unit 300 coupled to the second container 200 to be movable up and down and configured to discharge the second kind of makeup 20 to the first container 100 such that the first kind of makeup 10 and the second kind of makeup 20 are mixed.

The first container 100, as shown in FIG. 1, is larger in size than the second container 200 and can store the first kind of makeup 10 therein. In the embodiment, the first kind of makeup 10 stored in the first container 100 may be different in kind from the second kind of makeup 20 stored in the second container 200. For example, the first kind of makeup 10 and the second kind of makeup 20 may be different liquid type substances, or one of them may be a liquid type and the other one may be a powder or gel type.

In the embodiment, the first container 100, as shown in FIG. 3, includes a first container body 110 storing the first kind of makeup 10, a discharger 120 disposed under the first container body 110 and discharging the first kind of makeup 10 stored in the first container body 110 out of the first container body 110, and a first container cap 130 detachably coupled to the upper portion of the first container body 110.

The first container body 110 of the first container 100, as shown in FIG. 1, may have a cylindrical shape and the first container body 110 can be stored therein.

In the embodiment, the discharger 120 is disposed under the first container body 110, as shown in FIG. 1, and the first kind of makeup 10 stored in the first container body 110 can be discharged out of the first container body 110 through the discharger 120.

In the embodiment, first threads 111 are formed at the upper end portion of the first container body 110, as shown in FIG. 1, and the first container cap 130 can be detachably coupled by the first threads 111. A second container body 210 of the second container 200 can be detachably coupled by second threads to the first threads 111 with the first container cap 130 separated. In the embodiment, the second threads may be formed on the outer side of the upper portion of the second container body 210.

The discharger 120 of the first container 100, as shown in FIG. 1, is disposed under the first container 110 and can discharge the first kind of makeup 10 stored in the first container body 110 to the outside.

In the embodiment, the discharger 120, as shown in FIG. 1, includes a main body 121, a discharge guide rod 123 disposed in the main body 121 and discharging a mixture of the first kind of makeup 10 and the second kind of makeup 20 flowing into the main body 121 to the outside, and a cover body 127 coupled to the main body 121 to cover the main body 121.

A slit 122 may be formed at the main body 121 of the discharger 120, as shown in FIG. 1, and an outlet 125 for discharging the mixture of the first kind of makeup 10 and the second kind of makeup 20 may be formed in the discharge guide rod 123.

Meanwhile, in the present disclosure, the configuration of the 'discharging apparatus for cosmetic" disclosed in Korean Patent No. 10-1817163 by the applicant(s) may be intactly applied.

The first container cap 130 of the first container 100, as shown in FIG. 2, may be detachably thread-fastened to the upper end portion of the first container body 110.

In the present disclosure, the first container cap 130 is separated from the first container 100 to couple the second container 200 to the first container 100, so the region of the first container body 110 to which the first container cap 130 was coupled can be provided as a coupling portion for the second container 200.

In the present disclosure, as shown in FIG. 2, a sealer 131 is disposed at the first container cap 130, whereby the open top of the first container body 110 can be sealed.

The second container 200, as shown in FIG. 1, is provided separately from the first container 100, is coupled to the first container 100 when it is used, and can supply the second kind of makeup 20 to the first container 100 by operation of the mixing unit 300.

In the embodiment, the second container, as shown in FIG. 2, includes a second container body 210 storing the second kind of makeup 20, a second container storage body 220 coupled to the second container body 210 and storing the second kind of makeup 20, and a second container separation cap 230 detachably coupled to the second container body 210 to surround the second container storage body 220.

The second body 210 of the second container 200 may be detachably thread-fastened to the first container body 110 with the first container cap 130 separated.

In the embodiment, the second container storage body 220 may be coupled inside the second container body 210, as shown in FIG. 2.

In the present disclosure, second threads are formed on the upper end portion of the second container body 210. The second threads can be engaged with the first threads 111 formed on the upper end portion of the first container body 110 when the second container 200 is coupled to the first container 100.

The second kind of makeup 20 is stored in the second container storage body 220 of the second container 200, and the stored second kind of makeup 20 can be supplied to the first container body 110 by operation of the mixing unit 300 and can be mixed with the first kind of makeup 10.

In the embodiment, a coupling groove is formed on the outer wall of the second container storage body 220, as shown in FIG. 2, and a coupling protrusion 211 of the second container body 210 can be inserted in the coupling groove 221.

The outer wall of the second container separation cap 230 of the second container, as shown in FIG. 2, is thread-fastened to the inner wall of the second container body 220, and the second container separation cap 230 can be separated from the second container body 210 to couple the second container 200 to the first container 100.

Figure 4:
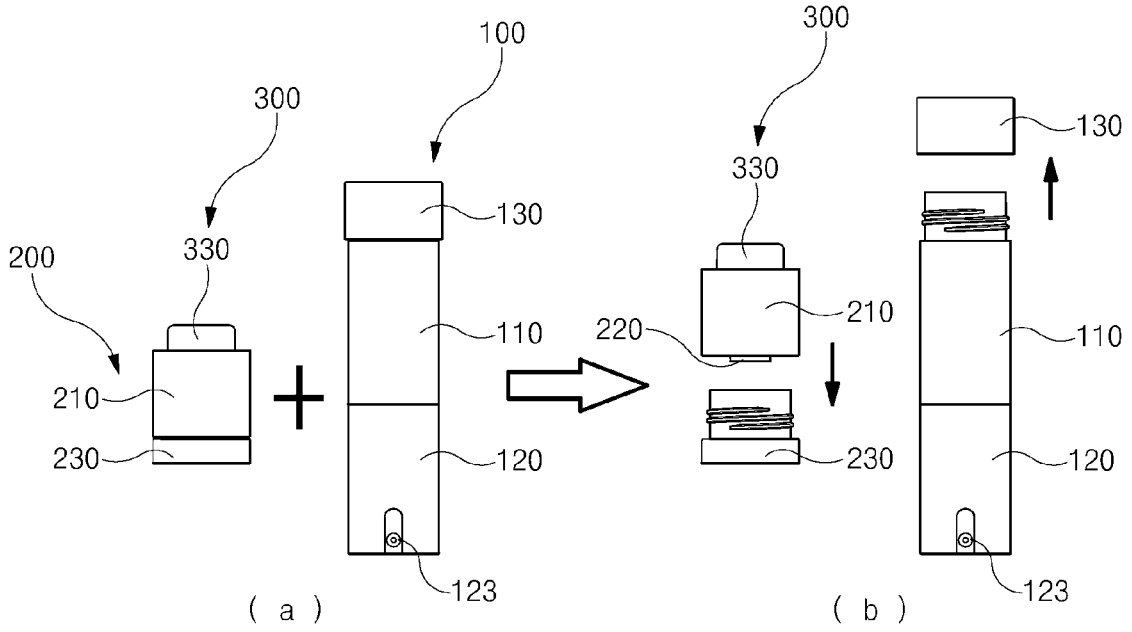
FIG. 4 is an operation view of the embodiment that schematically shows the state in which a first container cap and a second container cap have been separated.

The mixing unit 300, as shown in FIG. 4, is coupled to the second container 200, thereby being able to enable the second kind of makeup 20 stored in the second container 210 to be supplied to the first container body 110.

In the embodiment, the mixing unit 300, as shown in FIG. 2, includes a mixing body 310 coupled to the inner wall of the second container storage body 220 to be movable up and down, a boring blade 320 disposed at the mixing body 310 and boring a boring portion 222 formed in the second container storage body 220, and a mixing head 330 formed to be exposed to the outside of the second container body 210 and being pressed by a user.

The second kind of makeup 20 may be stored in the mixing body 310 of the mixing unit 300 or, the lower end of the mixing body 310 may be open and the second kind of makeup 20 stored in the second container storage body 220 may flow into the mixing body 310.

The boring blade 320 of the mixing unit 300, as shown in FIG. 2, is formed such that a side is inclined, so the boring blade 320 can bore the boring portion 222 formed at the second container storage body 220.

The mixing head 330 of the mixing unit 300, as shown in FIG. 2, may be larger in diameter than the mixing body 310 and may be provided as a portion that is pressed by a user.

Figure 5:
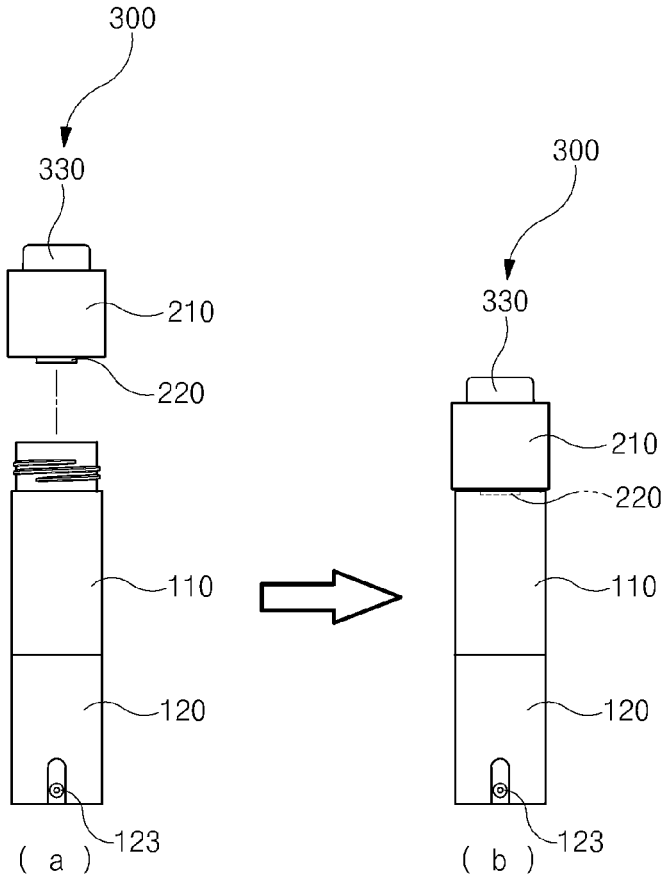
FIG. 5 is an operation view of the embodiment that schematically shows the state in which a second container with a second container separation cap separated is coupled to the first container with the first container cap separated.
Figure 6:
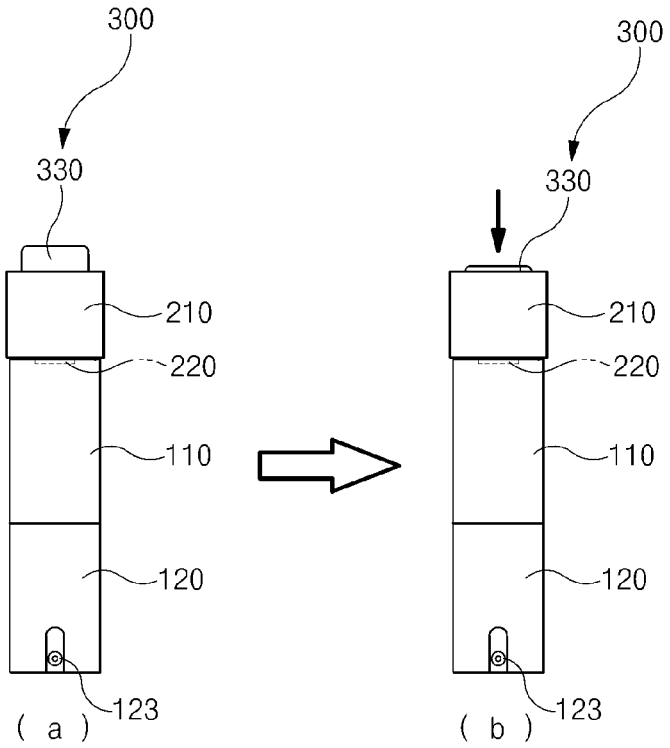
FIG. 6 is an operation view of the embodiment that schematically shows the state in which a mixing head of a mixing unit is pressed down so that a first kind of makeup and a second kind of makeup are mixed with each other.
Figure 7:
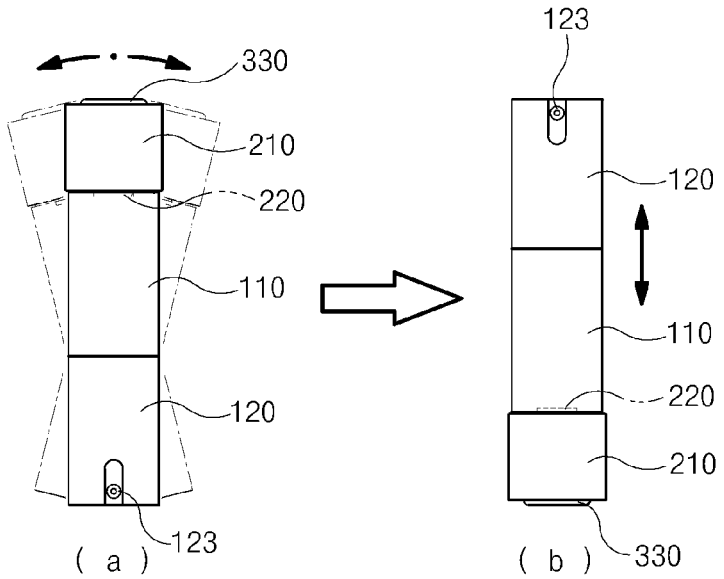
FIG. 7 is an operation view of the embodiment that schematically shows the state in which the assembled container has been turned upside down to use after shaken for mixing.

FIG. 4 is an operation view of the embodiment that schematically shows the state in which the first container cap 130 and the second container cap 230 have been separated, FIG. 5 is an operation view of the embodiment that schematically shows the state in which the second container 200 with the second container separation cap 230 separated is coupled to the first container 100 with the first container cap 130 separated, FIG. 6 is an operation view of the embodiment that schematically shows the state in which the mixing head 330 of the mixing unit is pressed down so that the first kind of makeup 10 and the second kind of makeup 20 are mixed together, and FIG. 7 is an operation view of the embodiment that schematically shows the state in which the assembled container has been turned upside down to use after shaken for mixing.

Hereafter, the operation principle of the embodiment is briefly described with reference to the figures.

In order to use the embodiment, a user separates the first container cap 130 and the second container separation cap 230 shown in FIG. 4(*a*), as shown in FIG. 4(*b*).

In this state, the user, as shown in FIG. 5(*a*), couples the second container 200 with the second container separation cap 230 separated to the first container 100 with the first container cap 130 separated.

Next, the user, as shown in FIG. 6(*b*) pressed down the mixing head 330 of the mixing head 300. Accordingly, the boring portion 222 of the second container storage body 220 is bored by the boring blade 320 of the mixing unit 300, so the second kind of makeup 20 stored in the second container storage body 220 and the first kind of makeup 10 stored in the first container body 110 can be mixed with each other.

Finally, the user, as shown in FIG. 7, can mix the two kinds of makeup by shaking the assembled container and then can turn upside down the container for use.

Embodiments of the present disclosure can mix different kinds of makeup, easily replace the makeup with other kinds of makeup, and provide more choices of makeup.

What is claimed is:

1. A mixing container for different kinds of makeup, the mixing container comprising:

a first container configured to store a first kind of makeup;

a second container detachably coupled to the first container and configured to store a second kind of makeup; and a mixing unit coupled to the second container to be movable up and down and configured to discharge the second kind of makeup to the first container such that the first kind of makeup and the second kind of makeup are mixed, wherein the first container and the second container are independently separated, and when the first container and the second container are coupled and then the mixing unit is pressed, the mixing unit bores a portion of the second container and the second kind of makeup stored in the second container enters the first container, so the first kind of makeup and the second kind of makeup are mixed with each other, wherein the first container includes:

a first container body configured to store the first kind of makeup;

a discharger disposed under the first container body and configured to discharge the first kind of makeup stored in the first container body out of the first container body; and a first container cap detachably coupled to an upper portion of the first container body, and the second container is detachably coupled to a region of the first container body from which the first container cap has been separated.

2. The mixing container of claim 1, wherein the second container includes:

a second container body configured to store the second kind of makeup;

a second container storage body coupled inside the second container body and configured to store the second kind of makeup; and a second container separation cap detachably coupled to the second container body to surround the second container storage body.

3. The mixing container of claim 2, wherein the second container separation cap and the first container cap of the first container are separated to couple the second container to the first container, and an outer wall of the second container body is thread-fastened to the region of the first container body from which the first container cap has been separated.

4. The mixing container of claim 2, wherein the mixing unit includes:

a mixing body coupled to an inner wall of the second container storage body to be movable up and down;

a boring blade disposed at the mixing body and configured to bore a boring portion formed in the second container storage body; and a mixing head formed to be exposed to the outside of the second container body and configured to be pressed by a user.

* * * * *